US008282496B2

(12) United States Patent
Gordon et al.

(10) Patent No.: US 8,282,496 B2
(45) Date of Patent: Oct. 9, 2012

(54) AMUSEMENT APPARATUS

(76) Inventors: Jonathan I. Gordon, Alexandria, VA (US); David P. Gordon, Stamford, CT (US)

( * ) Notice: Subject to any disclaimer, the term of this patent is extended or adjusted under 35 U.S.C. 154(b) by 0 days.

(21) Appl. No.: 12/881,884

(22) Filed: Sep. 14, 2010

(65) Prior Publication Data

US 2011/0111870 A1 May 12, 2011

Related U.S. Application Data

(63) Continuation of application No. 11/938,828, filed on Nov. 13, 2007, now Pat. No. 7,794,330.

(51) Int. Cl.
*A63G 1/36* (2006.01)
*A63G 1/00* (2006.01)

(52) U.S. Cl. ..... 472/38; 472/43; 104/60

(58) Field of Classification Search ..... 472/29–38, 472/118; 104/53, 60, 64
See application file for complete search history.

(56) References Cited

U.S. PATENT DOCUMENTS

| | | | | |
|---|---|---|---|---|
| 1,128,890 | A | 2/1915 | Mangels | |
| 1,424,850 | A | 8/1922 | Purcell | |
| 1,527,893 | A | 2/1925 | Mangels | |
| 1,549,927 | A | 8/1925 | Sherry | |
| 1,652,975 | A | 12/1927 | Davidson | |
| 1,682,803 | A | 9/1928 | Rouge | |
| 1,817,373 | A | 8/1931 | Hopkins | |
| 1,877,656 | A | 9/1932 | Giraud | |
| 1,997,940 | A | 4/1935 | Lundberg | |
| 2,206,172 | A | 7/1940 | Etes | |
| 2,546,917 | A | 3/1951 | Bergen | |
| 2,721,081 | A | 10/1955 | Sipior | |
| 2,838,863 | A | 6/1958 | Paul | |
| 3,410,223 | A * | 11/1968 | Miller | 104/60 |
| 3,895,691 | A | 7/1975 | Shiraishi | |
| 4,163,555 | A * | 8/1979 | Norwalt et al. | 463/62 |
| 4,682,547 | A | 7/1987 | Schwarzkopf | |
| 5,016,540 | A | 5/1991 | Barber | |
| 5,209,340 | A | 5/1993 | Munkner et al. | |
| 5,280,831 | A | 1/1994 | Conklin, Jr. | |
| 5,453,053 | A | 9/1995 | Danta et al. | |
| 5,527,221 | A | 6/1996 | Brown et al. | |
| 5,803,815 | A | 9/1998 | Kitchen | |
| 6,022,276 | A | 2/2000 | Knijpstra | |
| 6,634,491 | B1 | 10/2003 | Specht | |
| 6,796,908 | B2 | 9/2004 | Weston | |
| 7,610,859 | B1 | 11/2009 | Dietrich | |
| 7,685,944 | B2 * | 3/2010 | Kilbert et al. | 104/53 |
| 2005/0197195 | A1 | 9/2005 | Zamperla et al. | |

* cited by examiner

*Primary Examiner* — Kien Nguyen
(74) *Attorney, Agent, or Firm* — Gordon & Jacobson, PC

(57) ABSTRACT

An amusement apparatus has a platform with a slot that follows a continuous course including both clockwise and counterclockwise turns, a plurality of cars each supported by respective wheels that ride on the platform, an elongate flexible drive member that translates along a path corresponding to the slot, a plurality of couplers corresponding to the plurality of cars, each respective coupler including a member which couples a corresponding car to the drive member with the couplers allowing the corresponding cars to move away from the slot in opposite directions in response to whipping forces resulting from translational movement of the drive member in clockwise and counterclockwise turns of the path, and springs for the cars that act on the cars to move the cars toward the slot in order to counteract the movement of the car away from the slot as caused by the whipping forces.

19 Claims, 8 Drawing Sheets

14
14
14

214g
214j-3
214j-2
214j-1
214i 214g
214f
214e 214g
214j
214i 214j-3
214j-2
214j-1
214
214f
212-3
212-2
212-1
212
214g
214f
214
214j
212-3

AMUSEMENT APPARATUS

This is a continuation of U.S. Ser. No. 11/938,828 filed on 11/13/20007, issuing as U.S. Pat. No. 7,794,330.

BACKGROUND OF THE INVENTION

1. Field of the Invention

This invention relates broadly to amusement devices. More particularly, this invention relates to an amusement device in which passengers ride in a car which "whips" around turns.

2. State of the Art

William F. Mangels was granted U.S. Pat. No. 1,128,890 in 1915 for an amusement apparatus which became well known as "The Whip". It consists of a sprocket wheel and an idler wheel coupled to each other by a chain or system of cables. Wheeled cars are coupled to the chain at intervals, each car being coupled to the chain through a horizontal arm, brace and spring arrangement. The sprocket is turned by a motor which turns the wheel that moves the chain that leads the cars around a wooden oval track, whipping them as they circle around each end of the track. One of the oldest Whips operating today is The Whip at Dorney Park & Wildwater Kingdom in Allentown, Pa. It was manufactured in 1918. The Whip at Playland in Rye, N.Y. was made in 1928, and is one of the park's oldest rides.

SUMMARY OF THE INVENTION

The present invention includes a plurality of pulleys which are mounted under a preferably horizontal platform with their axes of rotation being vertically oriented. A cable is threaded around the pulleys and a drive motor is coupled to one of the pulleys. When the motor is activated, it causes the cable to travel over the pulleys under the platform. Wheeled passenger vehicles are arranged on top of the platform and are coupled to the cable via a slot in the platform. The wheels are preferably caster-type wheels, although ball and cup rollers could be used which allow the vehicles to roll in a plurality of directions. The coupling of the vehicles to the cable is via a spring biased self-centering swing arm. According to one embodiment, the cable and the slot traverse substantially the same path, within allowable tolerances, with the cable being directly below the slot.

According to one aspect of the invention, the cable and pulleys are arranged so that the path of the cable has both left (counterclockwise) and right (clockwise) turns separated by straightaways. In this manner, the vehicles are caused to whip around both left and right turns, whipping in opposite directions. According to another aspect of the invention, a variety of different radius turns are provided. According to still another aspect of the invention, the slot in the platform is covered by a preferably continuous segmented belt assembly. The belt assembly conceals the slot allowing the wheels of the vehicles to ride on a relatively smooth surface when whipping without being abraded by passing over slot edges. The belt assembly also serves to protect passengers from tripping over the slot when entering and exiting the vehicles. According to yet another aspect of the invention, the platform is provided with a topography including hills and valleys.

According to another embodiment, the cable and the slot traverse different paths which are often substantially parallel but laterally spaced apart. In this embodiment, a vertical component couples the swing arm of the each vehicle to the cable via an extension rod. The extension rod is pivotally coupled to the cable so that it may assume an angle relative to the path of the cable. In this embodiment, the path of the slot is often spaced apart from the path of the cable by an amount preferably less than the length of the extension rod (i.e., the extension rod is angled at an acute angle relative to the cable). The slot is arranged to the left of the cable when approaching a right turn and is spaced to the right of the cable when approaching a left turn. The slot is arranged to cross over from right to left and left to right as needed. When a vehicle crosses over the cable, the extension rod pivots from extending out from one side of the cable to extending out from the other side of the cable. Optional features of this embodiment include the placement of bearings between the slot edges and the vertical component of the swing arm, and/or using a clutch mechanism to lock and unlock the extension rod from rotating relative to the cable.

Additional aspects and advantages of the invention will become apparent to those skilled in the art upon reference to the detailed description taken in conjunction with the provided figures.

DETAILED DESCRIPTION OF THE PREFERRED EMBODIMENTS

Figure 1:
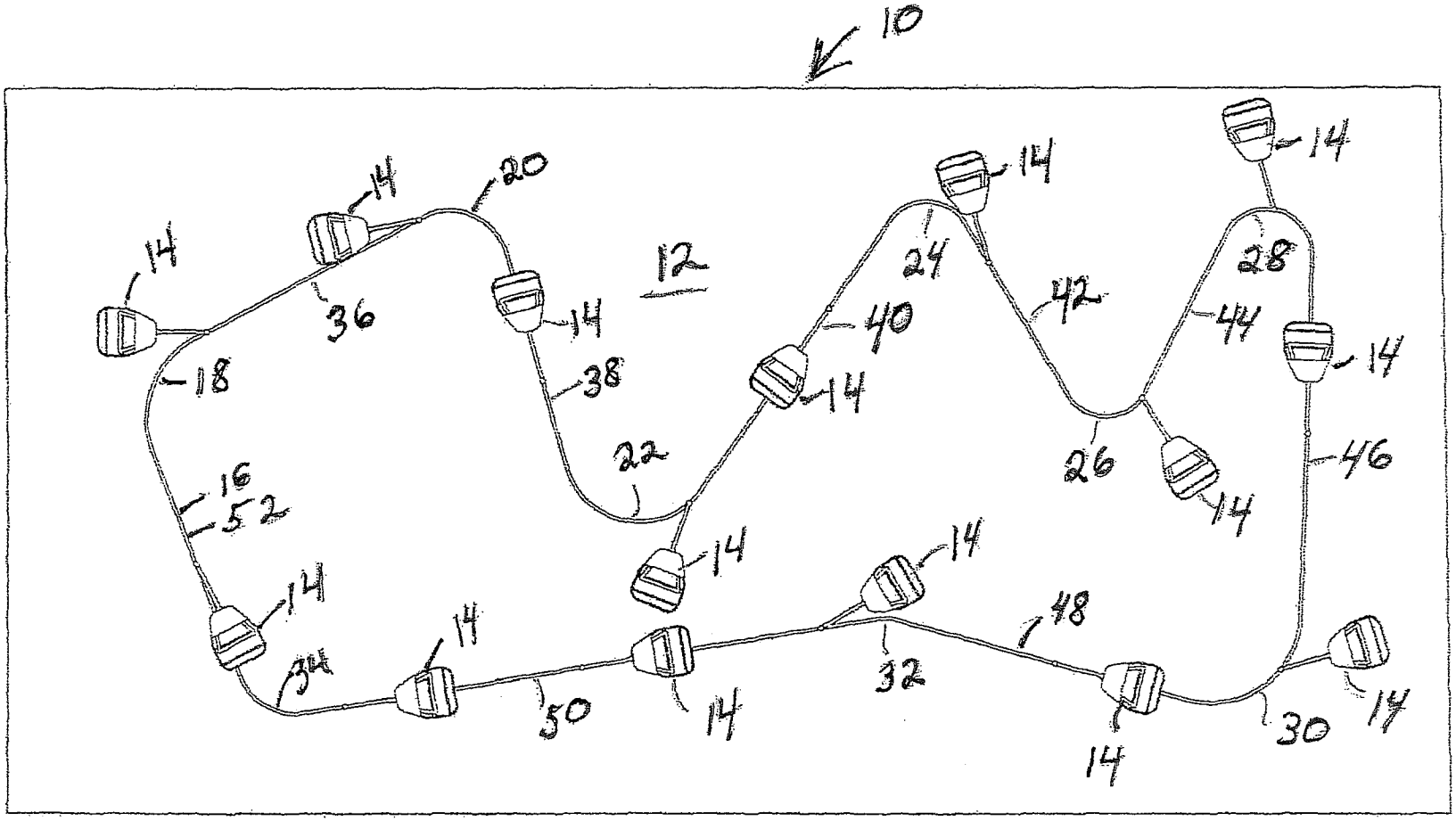
FIG. 1 is a plan view of the platform and passenger vehicles according to a first embodiment of the invention.

Turning now to FIG. 1, an amusement apparatus 10 according to a first embodiment of the invention includes a platform 12 and a plurality of passenger vehicles 14 arranged to roll on the platform. The platform defines a slot 16 which extends through a serpentine continuous endless course about the platform. The course includes turns, e.g. 18, 20, 22, 24, 26, 28, 30, 32, 34. The turns are separated by straightaways, e.g. 36, 38, 40, 42, 44, 46, 48, 50, 52. It will be appreciated that some of the turns are right (clockwise) turns, 18, 20, 24, 28, 30, and 34 and some are left (counterclockwise) turns, 22, 26, and 32. It will also be appreciated that the radius of curvature of the turns may vary as may the distance between the turns with some of the turns being "tighter" than others. The cars 14 are each coupled to a drive system located beneath the platform 12 via the slot 16 as described below with reference to FIGS. 3 and 4. The drive system is illustrated in FIG. 2.

Figure 2:
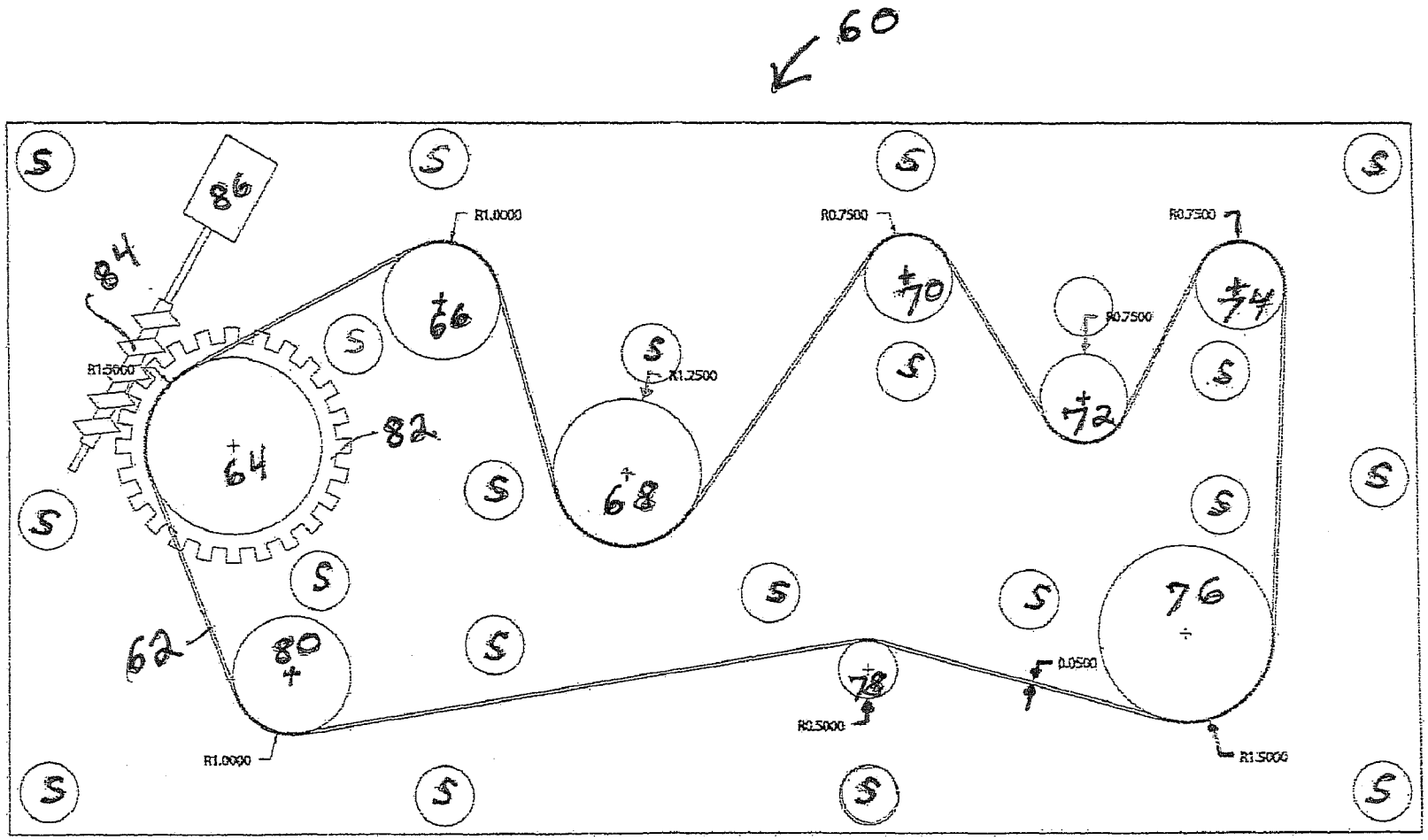
FIG. 2 is a plan view of the pulley and cable system underneath the platform of FIG. 1.

Referring now to FIG. 2, the drive system 60 includes an endless cable 62 which is threaded around a series of pulleys, e.g. 64, 66, 68, 70, 72, 74, 76, 78, and 80 each preferably having a vertical axis of rotation. The cable is preferably a steel fiber or steel rope of the type commonly used in various amusement park rides. Comparing FIGS. 1 and 2, it will be appreciated that the slot 16 is located above the cable 62 and the slot and cable traverse substantially the same path within acceptable tolerances. It will also be appreciated that the locations of the pulleys 64, 66, 68, 70, 72, 74, 76, 78, and 80 correspond to the locations of the turns 18, 20, 22, 24, 26, 28, 30, 32, 34. It will further be appreciated that the radius of each pulley corresponds to the radius of the turn to which the pulley corresponds. In the illustrated embodiment, pulleys 66 and 80 have a radius of one unit whereas the pulley 78 has half that radius. The pulleys 64 and 76 have the largest radius, one and one half units each. The pulleys 70, 72, and 74 each has a radius of three quarters of a unit and the pulley 68 has a radius of one and one quarter units. In a full scale assembly, each unit may represent four feet. In a very large installation, a ten foot or twelve foot radius could be used. Of course, other sizes and relative sizes could be used.

In the illustrated embodiment, the pulley 64 is bonded to a gear 82 which is engaged by a screw 84 driven by a motor 86. When the motor is activated, it causes the pulley to rotate which propels the cable 62 around the pulleys and drags the vehicles 14 around the course defined by the cable 62 and the slot 16. Of course, those skilled in the art will recognize that any drive system can be utilized; e.g., a right angle gear driven system with a gearbox. As illustrated, the cable has a width of one twentieth of a unit and the slot is slightly wider than that. Of course, other widths for the cable and slot are likely to be used.

It will also be appreciated that FIG. 2 includes a plurality of cylindrical supports S which support the platform 12 in a substantially horizontal orientation as shown in FIG. 1. The supports are distributed to support the mass of the platform as well as the mass of the vehicles and passengers as they move over the platform.

Figure 3:
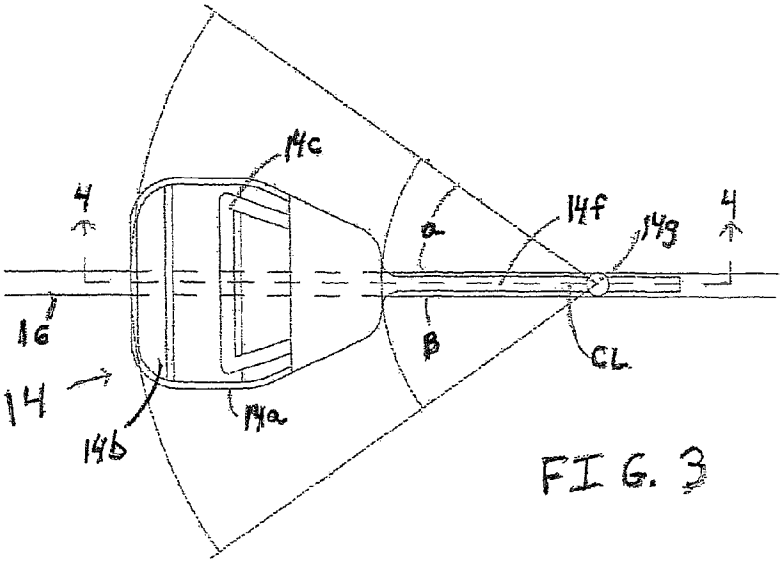
FIG. 3 is a plan view of a passenger vehicle according to the first embodiment of the invention.
Figure 4:
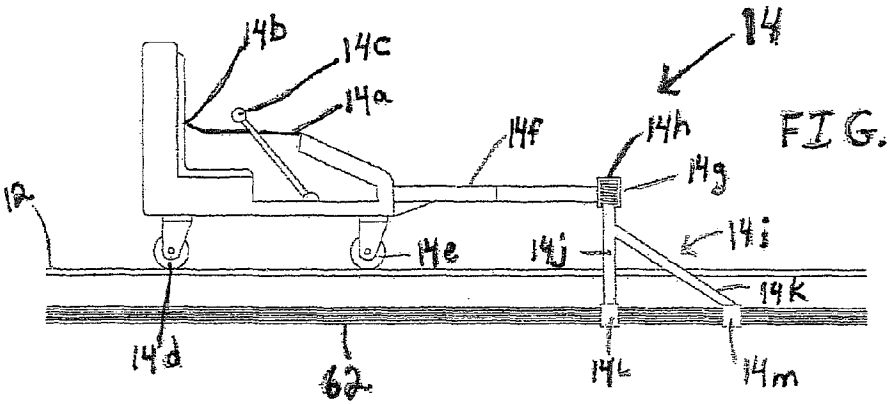
FIG. 4 is a view taken along line 4-4 in FIG. 3.

Turning now to FIGS. 3 and 4, the details of the vehicle 14 are shown in conjunction with the above described platform 12, slot 16, and cable 62. The vehicle includes a main body 14*a* which houses a seat 14*b* and a lap bar 14*c*. The seat may be dimensioned to accommodate a single passenger or a group of passengers. The lap bar 14*c* is preferably locked in place when the vehicle is in motion to prevent passengers from disembarking the vehicle while it is in motion. The main body 14*a* is supported by four caster-type wheels, two of which 14*d*, 14*e* can be seen in FIG. 4. In one embodiment the wheels are between four and eight inches in diameter and have a width of three to five inches assuming a slot width of two inches. Of course, other size wheels can be used for the same or different slot width. The main body 14*a* of the vehicle 14 is coupled to the cable 62 via a swing coupling which preferably includes a generally horizontal member which is coupled via a spring bias coupling to a member having a vertical component. More particularly, a horizontally oriented swing arm 14*f* extends forward from the main body 14*a* and terminates in a hub 14*g*. In one embodiment the length of the swing arm is between five to eight feet. However, the length of the swing arm may be equal in length to the length of the main body 14*a*, or may be shorter or longer. In selecting a swing arm length, care must be taken to assure that the cars will not collide on the course. The hub 14*g* is coupled to the top of a yoke 14*i* via a torsion spring 14*h*. The yoke 14*i* preferably includes a substantially vertical arm 14*j* and an angled arm 14*k* which includes a vertical component, with both arms traversing the slot 16. The provision of a yoke having two arms with a vertical component adds stability to the swing coupling, although it will be appreciated that a yoke with a single arm having a vertical component can be utilized. The lower ends of both vertical components of the yoke are coupled at 14*l* and 14*m* to the cable 62 which is located beneath the platform 12. If the cable 62 is a steel fiber cable or steel rope, the couplings at 14*l* and 14*m* are clasps. If the cable is a chain, the coupling may be bolts or modified chain links.

It will be appreciated from FIGS. 1 and 3 that it may be desirable to limit the left and right movement of the swing arm 14*f*. For example, movement of the swing arm may be limited to an angle of $\alpha$ in one direction and an angle of $\beta$ in the other direction. The angles may be the same or different. Limits may be set by the choice of the torsion spring 14*h* and/or by the provision of stops (not shown) in the hub 14*g*.

From the foregoing, those skilled in the art will appreciate that when the motor is engaged, the cable will be propelled over the pulleys, dragging the vehicles across the platform along the path defined by the slot. As a vehicle traverses a turn, inertia causes the vehicle to continue traveling in the same direction. This results in a rotation of the swing arm about its respective hub which imparts centripetal force to the vehicle thereby "whipping" the vehicle around the turn. Once the hub returns to a straightaway, the torsion spring returns the vehicle to a substantially straight path. Depending on the velocity and mass of the vehicle and the strength of the spring, it may whip to the opposite direction (i.e. beyond slot 16) before returning to a straight path.

Figure 5:
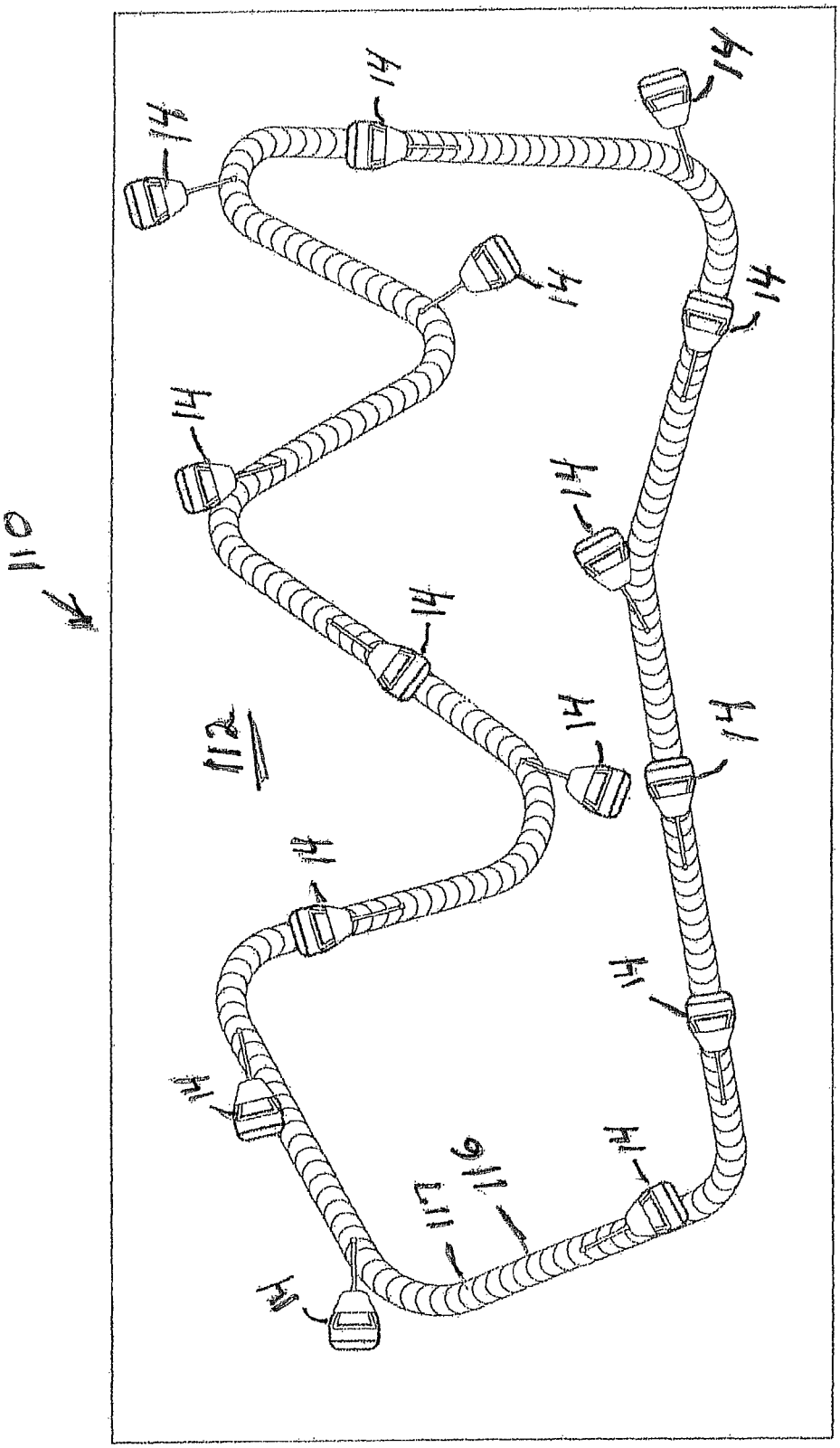
FIG. 5 is a view similar to FIG. 1, showing an implementation of the invention having a segmented conveyor belt according to a second embodiment of the invention.

Turning now to FIG. 5, another implementation of an amusement apparatus 110 is shown. In this implementation, the slot 116 through which the vehicles 14 are coupled to the cable (not shown in this figure) is covered by a multi-segment flat conveyor belt 117 of the general type used in airport luggage conveyors. Examples of this type of belt arrangement can be found in the following U.S. patents, the complete disclosures of which are hereby incorporated by reference herein: U.S. Pat. Nos. 1,424,850; 1,817,373; 3,895,691; 5,280,831; and 6,634,491.

The belt 117 is substantially flush with the platform 112 so that as the vehicles whip from left to right and right to left they roll over a substantially smooth surface. This prevents the wheels of the vehicles from being abraded by the edges of the slot. In addition, the multi-segment conveyor belt 117 prevents the possibility that riders will catch their shoes in the slot when boarding and disembarking the vehicles 14.

Figure 6:
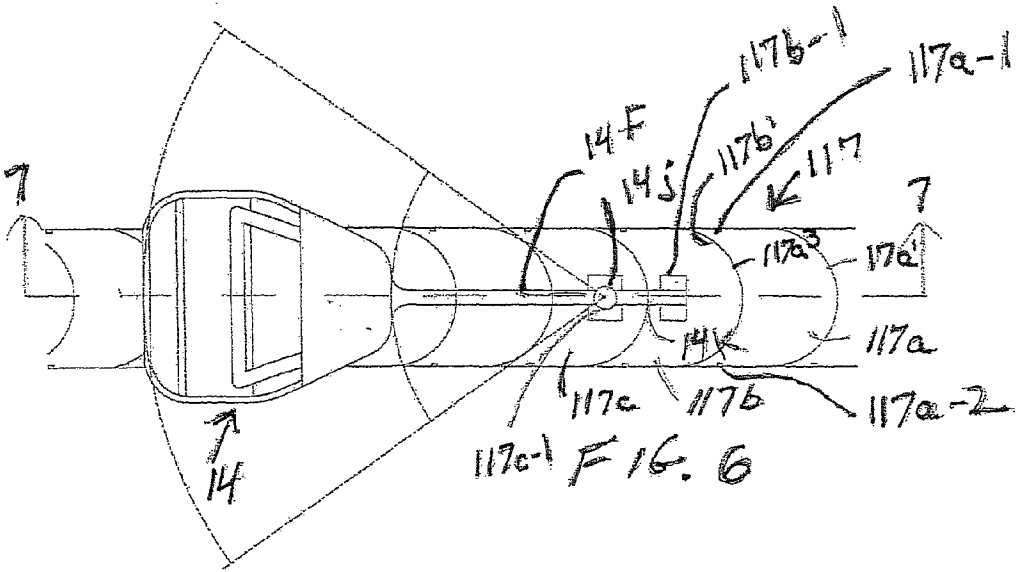
FIG. 6 is a view similar to FIG. 3 showing a passenger vehicle in conjunction with the second embodiment of the invention.
Figure 7:
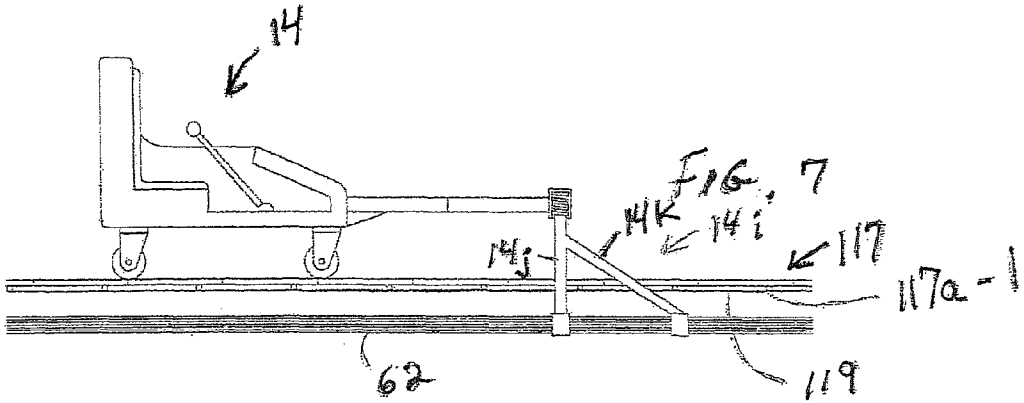
FIG. 7 is a view taken along line 7-7 in FIG. 6.

FIGS. 6 and 7 are similar to FIGS. 3 and 4 but illustrate the multi-segment conveyor belt 117 relative to the vehicle 14, the cable 62, and the yoke 14*i*. As seen best in FIG. 6, the conveyor belt is composed of a plurality of segments (e.g. 117*a*, 117*b*, 117*c*) each having a convex circular front end (e.g. 117*a*') and a concave circular rear end (e.g. 117*a*"). The front end (e.g. 117*b*') of one segment (e.g. 117*b*) mates with the rear end (e.g. 117*a*") of a forward adjacent segment (e.g. 117*a*) allowing the segments to rotate relative to each other in a horizontal plane. The nature of this rotation can be seen best in FIG. 5. Each segment is optionally provided with a pair of small wheels or rollers (e.g. 117*a*-1 and 117*a*-2) which allow the segments to move forward with minimal resistance. Where provided, the wheels or rollers are preferably supported by a pair of smooth tracks, one of which 119 can be seen in FIG. 7.

As seen best in FIG. 6, for each vehicle 14, two adjacent segments (e.g. 117*b* and 117*c*) of the multi-segment conveyor belt are provided with cutouts (e.g. 117*b*-1 and 117*c*-1) through which the yoke portions 14*j*, 14*k* pass in order to be coupled to the cable 62 (FIG. 7). It will be appreciated that when the swing arm 14*f* is centered as shown in FIG. 6, depending upon the width of the belt, the wheels of the vehicle may reside solely on the conveyor belt 117 and therefore not rotate as the vehicle 14 is pulled forward by the cable 62. However, as the vehicle 14 whips to the right or left around turns, the wheels will rotate as the vehicle rolls off the conveyor onto the platform 112 (see FIG. 5). In some embodiments the conveyor belt is narrow in width, and the wheels of the vehicle will straddle the conveyor belt when the vehicle is not being whipped.

Figures 8, 8A, 8B, 8C:
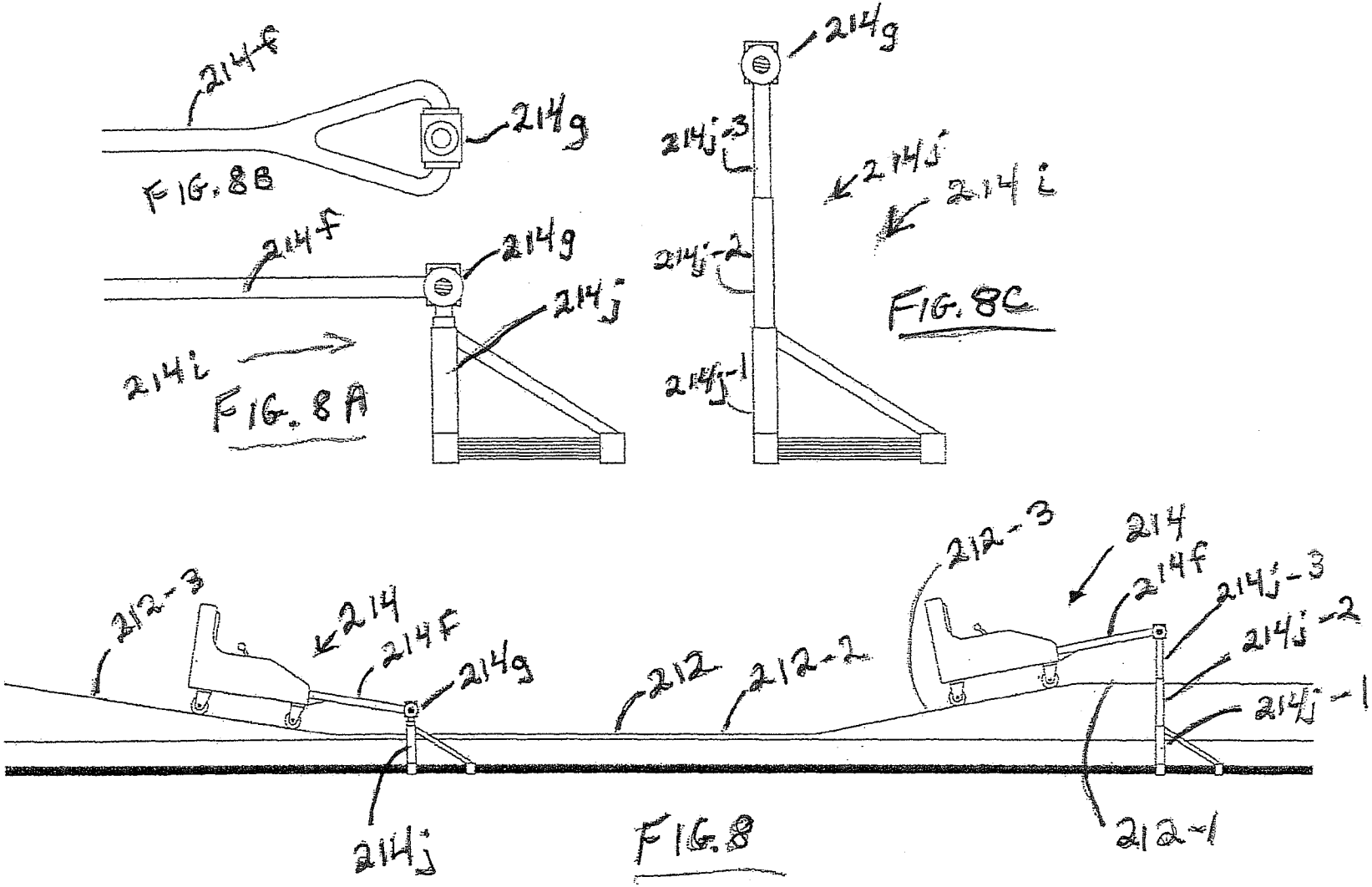
FIG. 8 is a side elevation view of another implementation of the invention showing a platform having a topography of hills and valleys according to a third embodiment of the invention.
FIG. 8A is an enlarged broken side elevation view in partial section of a modified swing arm, hub, and yoke.
FIG. 8B is an enlarged broken plan view of the modified hub and swing arm.
FIG. 8C is an enlarged side elevation view in partial section showing the vertical component of the yoke telescoped.

FIG. 8 shows another implementation of the invention wherein the platform 212 is provided with a topography of hills (e.g. 212-1) and valleys (e.g. 212-2) separated by ramps (e.g. 212-3). Thus, as the vehicles traverse the platform whipping right and left, they also ride up and down. In order to accommodate this up and down movement of the vehicles, the swing arm 214*f*, the hub 214*g* and the vertical component 214*j* of the yoke 214*i* have been modified. In particular, as seen best in FIGS. 8A and 8B, the swing arm 214*f* and the hub 214*g* have been joined by a hinged coupling.

As seen best in FIGS. 8, 8A and 8B, the vertical component 214*j* of the yoke 214*i* is made of telescoping sections 214*j*-1, 214*j*-2, and 214*j*-3 so that the length of the vertical component 214*j* automatically adjusts as the vehicle 214 rides up to a hill and down to a valley. Moreover, as seen in FIG. 8, angle between the swing arm 214*f* and the vertical component 214*j* of the yoke 214*i* can vary preferably up to ±20° from ninety degrees when the vehicle traverses a ramp (e.g. 212-3). In this embodiment, a multi-segment belt of the type shown in FIG. 5 could be used, provided that the segments are made of flexible preferably resilient material such as plastic or reinforced fabric and provided that the plastic or fabric is strong enough to hold the weight of the vehicles and riders and will not assume a permanent bend.

Figures 9, 10:
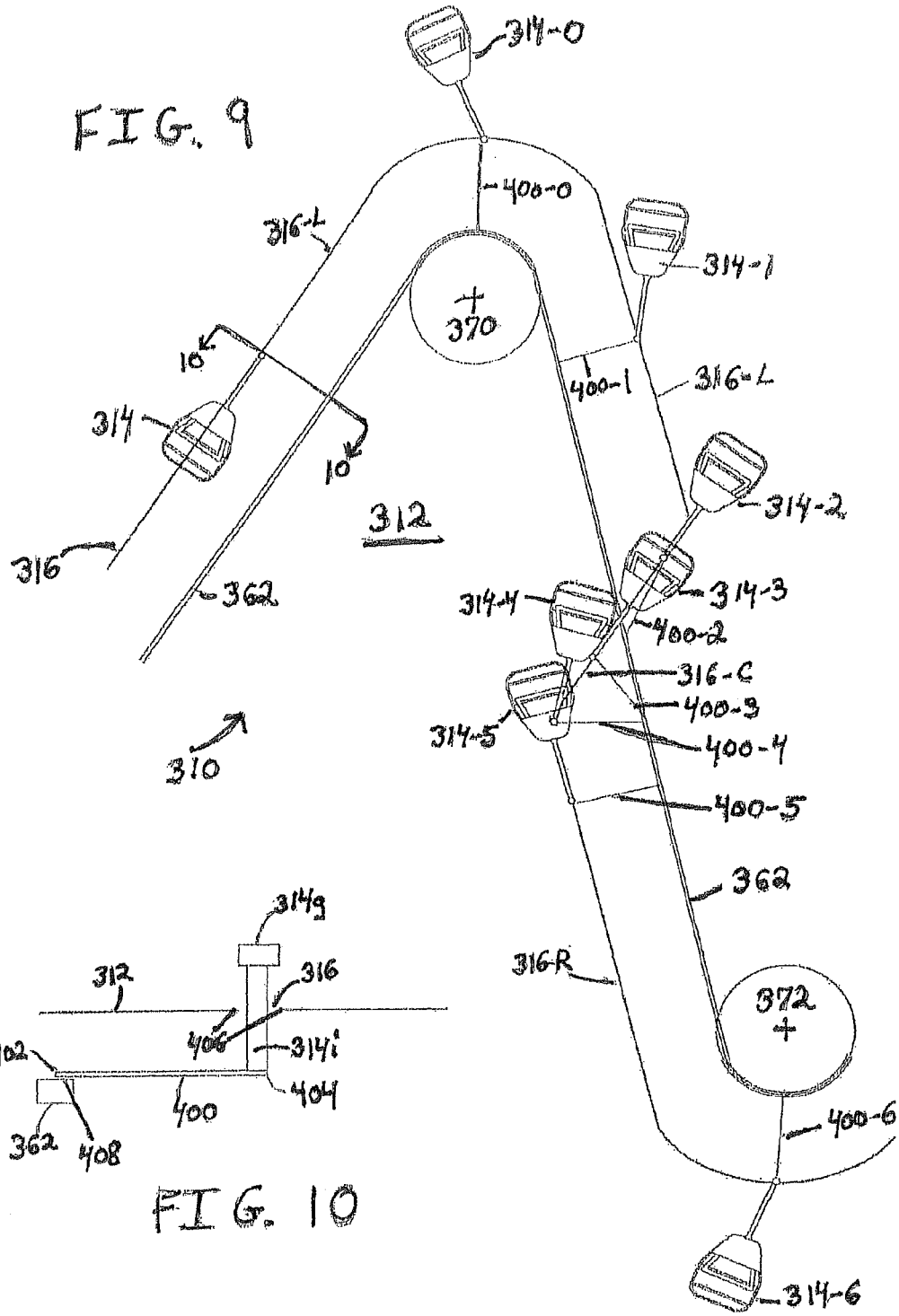
FIG. 9 is a broken transparent plan overlay view of a fourth embodiment of the invention.
FIG. 10 is a section taken along line 10-10 in FIG. 9.

FIG. 9 shows another embodiment of the invention. Part of the physics of the original whip ride is the recognition that spaced apart objects traveling in a parallel path at the same velocity will not travel at the same velocity when traveling around a turn. The object farthest from the center of the turn will travel much faster in order to remain side-by-side because it must traverse a longer path. This embodiment of the invention applies that principle to the concepts of the present invention. FIG. 9 is a transparent plan overlay view of the platform 312, vehicles 314, slot 316, cable 362 and pulleys 370, 372. It is an "overlay" because the "vehicles" 314, 314-0, 314-1, 314-2, 314-3, 314-4, 314-5 and 314-6 are actually the same vehicle at different points in the ride.

As shown in FIG. 9, the slot 316 in the upper portion of the figure is spaced apart to the left (as referenced by facing in the direction of vehicle travel) from the cable 362 and is thus designated 316-L. As seen best in FIG. 10, the vertical component 314*i* of the swing coupling of the vehicle 314 is coupled to the cable 326 by a horizontal extension rod 400. The rod is rotationally coupled at 402 to the cable 362 and rigidly coupled or rotationally coupled with limits to the bottom of the vertical component 314*i*. The top of component 314*i* is coupled via the hub 314*g* and via swing arm 314*f* to the vehicle 314 as described in the first embodiment. The coupling at 404 is preferably not fully rotational because that would abrogate the function of the torsion spring in the hub 314*g*. As the vehicle 314 approaches the turn defined by pulley 370, the extension rod 400 is shown to be perpendicular to the slot 316-L and the cable 362, although more preferably the extension rod 400 extends forward of the yoke 314*i* and makes an obtuse angle with the swing arm 314*f* (although they are in different planes) and acute angle with the cable 362 (as shown and described in the embodiment of FIG. 11). As the vehicle whips around the turn it assumes positions 314-0 and 314-1 with the extension rod at 400-0 and 400-1 still located to the left of the cable 362. Before approaching the turn defined by pulley 372, the vehicle 314 crosses over the cable 362 and enters a slot to the right 316-R of the cable. To do this, a diagonal slot 316-C (crossover) is provided which couples parallel slots 316-L and 316-R. As the vehicle enters the slot 316-C, shown at 314-2, the extension rod 400 rotates in a counter-clockwise direction as shown at 400-2. At some point, between 400-2 and 400-3, the rod 400 will be parallel to the cable 362. As the vehicle moves through positions at 314-4 to 314-5, the extension rod 400 returns to an angled orientation relative to the cable 362, but now extends in the opposite direction with the extension arm being located to the right of the cable. While FIG. 9 shows the extension arm being perpendicular at 400-5 to the cable, it is preferred that the arm be angled at an acute angle relative to the cable. Thus, preferably, the arm will have rotated less than 180° from its position at 400-1 to its position at 400-5. The vehicle is now in a position at 314-5 to whip around a left turn at 314-6. It will be appreciated that the slot 316-R may transferred back to another slot 316-L through a slot similar to slot 316-C which moves from right to left. It will be appreciated that the crossover slots need not be straight-line diagonal crossovers, as they can have curves, segments with different angles, etc.

Those skilled in the art will appreciate that the rotation of the extension rod 400 about the coupling 402 is driven by interaction between the vertical component 314*i* and the edges of the slots (316-C). This will induce friction between the component 314*i* and the slot edge(s), most likely the leading slot edge in slot 316-C. If the coupling 402 is freely rotational, there may also be some friction as the vehicle whips around turns. In order to limit the friction, a bearing arrangement 406 in the slot or on the vertical component and/or a clutch arrangement at 408 which will prevent rotation of the extension rod relative to the cable when such rotation is not necessary (i.e. at all points other than crossovers). Another way to reduce friction and make transitions from one side of the cable to the other is illustrated in FIG. 11.

Figure 11:
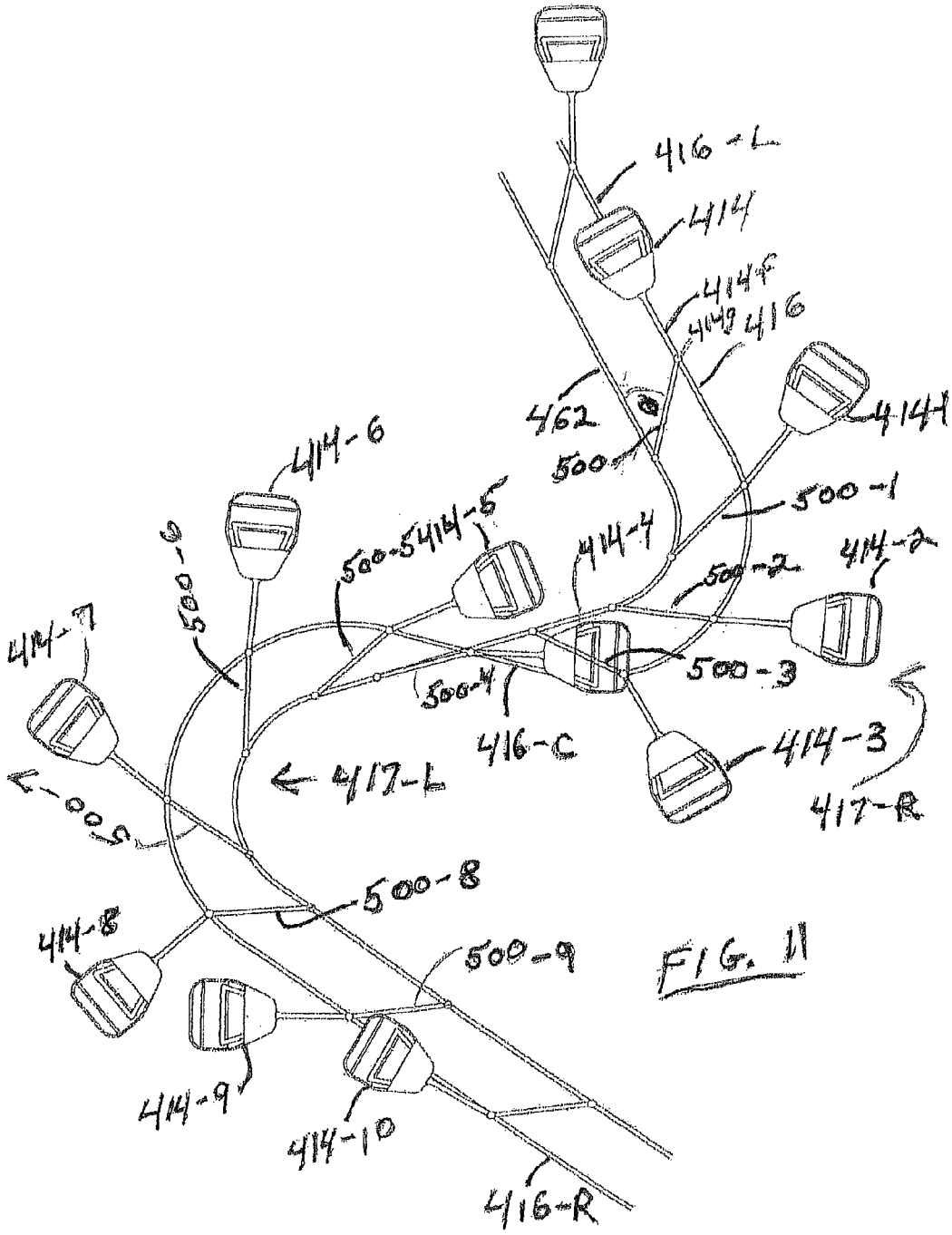
FIG. 11 is a broken transparent plan overlay view of an alternate implementation of the fourth embodiment.

Turning now to FIG. 11, the slot 416 has a straightaway 416-L on the left side of the cable 462 and a straightaway 416-R on the right side of the cable 462. The straightaway 416-L continues into a right turn 417-R which continues into a crossover straightaway 416-C. The crossover straightaway 416-C continues into a left turn 417-L which continues into the straightaway 416-R on the right side of the cable 462. The distance between the cable 462 and the slot 416 remains constant through the straightaways 416-L and 416-R as well as through portions of the turns adjacent to the straightaways. The main difference between the layout of FIG. 9 and the layout of FIG. 11 is that the crossover 416-C is flanked by two turns which are each greater than ninety degree. In addition, the acute angle between the extension rod and the cable 462 is shown.

More particularly, in the embodiment of FIG. 11, the swing arm 414*f* of the vehicle 414 is coupled to an extension rod 500 which forms an acute angle θ with the cable 462. That angle remains constant so long as the distance between the cable and the slot does not change. As illustrated in FIG. 11, the angle θ has a maximum value of about 45°, although other smaller or larger angles (preferably less than 90°) may be utilized. As the vehicle enters the first turn at 414-1, the angle θ of the extension rod 500-1 remains the same and continues to remain the same through the first 90° of the turn, e.g., until just before position 414-2, 500-2. The turn 417-R is approximately 130°. Thus, at the position 414-3, the angle θ of the extension rod 500-3 begins to decrease gently until the crossover 416-C is entered where the angle θ of the extension rod 500-4 quickly changes to zero as shown at position 414-4. Once the vehicle 414-5 has crossed over the cable 462, the angle of the extension rod 500-5 starts increasing and reaches its maximum (about 45°) after traversing 90° of the turn 417-L to the position 414-6, 500-6. The turn 417-L is approximately 160°. Therefore, through the last 70° of the turn, e.g. at positions 414-7, 500-7 and 414-8, 500-8, the extension rod is at its maximum angle.

As illustrated, as the vehicle 414 enters each turn it whips out from the turn. From the position before the first turn (414) through the position at 414-3, the vehicle whips through an angle of approximately 180°. From the position 414-3 to the position at 414-8, the vehicle whips through an angle of approximately 290° before returning through positions 414-9 and 415-10 to a straight trajectory.

There have been described and illustrated herein several embodiments of an amusement apparatus. While particular embodiments of the invention have been described, it is not intended that the invention be limited thereto, as it is intended that the invention be as broad in scope as the art will allow and that the specification be read likewise. Thus, while a particular layout of turns and straightaways has been illustrated, it will be appreciated that other layouts could be used as well, and turns need not be separated by straightaways. This also applies to the layout of hills, valleys and ramps. In addition, while an endless cable and pulleys have been disclosed, it will be understood that chains and sprockets or belts and rollers could be used. Also, while the drive system has been illustrated with a motor driving a screw which engages a gear, other motor arrangements could be used. While the illustrated embodiments show fifteen two passenger cars, it will be appreciated that cars having more or fewer passengers could be used and that the number and spacing of the cars depends on the course layout. Also, while it is preferable to limit rotation at the end of the swing arm and to provide spring biasing, it is possible to provide a freely swinging swing arm with no springs or stops. Further, while particular swing couplings which couple the car to the cable have been described, it will be appreciated that other couplings could be utilized. In addition, while particular wheel arrangements have been described, it will be appreciated that other wheel/roller arrangements could be utilized. Thus, for purposes herein, the term "wheel" will be deemed to include both wheels and rollers which vehicles to roll in a plurality of directions. It will therefore be appreciated by those skilled in the art that yet other modifications could be made to the provided invention without deviating from its spirit and scope as claimed.

What is claimed is:

1. An amusement apparatus, comprising:

a platform with a slot that follows a continuous course including both clockwise turns and counterclockwise turns;

a plurality of cars each supported by respective wheels that ride on the platform;

an elongate flexible drive member that translates along a path corresponding to said slot;

a plurality of couplers corresponding to said plurality of cars, each respective coupler including a member which couples a corresponding car to said drive member, said respective coupler allowing the corresponding car to move away from said slot in opposite directions in response to whipping forces resulting from translational movement of the drive member in clockwise and counterclockwise turns of the path; and at least one spring for each car that acts on the corresponding car to move the corresponding car toward said slot in order to counteract the movement of the corresponding car away from the slot as caused by the whipping forces.

2. An amusement apparatus according to claim 1, wherein:

said elongate flexible drive member is selected from the group including a cable and a chain.

3. An amusement apparatus according to claim 1, wherein:

said elongate flexible drive member is disposed under said slot over the course of said slot.

4. An amusement apparatus according to claim 1, wherein:

said elongate flexible drive member is offset laterally with respect to said slot over the course of said slot.

5. An amusement apparatus according to claim 1, wherein:

said each respective coupler comprises a member that extends through the slot.

6. An amusement apparatus according to claim 5, wherein:

said each respective coupler allows for clockwise and counterclockwise pivoting movement about said member.

7. An amusement apparatus according to claim 6, wherein:

clockwise turns of the path of the drive member impart clockwise pivoting movement of the car about said member, and counterclockwise turns of the path of the drive member impart counterclockwise pivoting movement of the car about said member.

8. An amusement apparatus according to claim 6, wherein:

said elongate flexible drive member is disposed under said slot over the course of said slot, and said member is connected to said elongate flexible drive member and extends vertically through the slot.

9. An amusement apparatus according to claim 8, wherein:

said each respective coupler comprises a spring that biases said swing arm to a position substantially parallel to said elongate flexible drive member.

10. An amusement apparatus according to claim 5, wherein:

said each respective coupler comprises a swing arm extending transverse to said member.

11. An amusement apparatus according to claim 1, wherein:

the path of said elongate flexible drive member is guided by at least one guide member supported below said platform.

12. An amusement apparatus according to claim 11, wherein:

said at least one guide member comprises a plurality of pulleys.

13. An amusement apparatus according to claim 1, further comprising:

a plurality of segments that are coupled to said flexible elongate drive member and move in conjunction with said drive member, wherein at least a portion of said slot is covered by said plurality of segments.

14. An amusement apparatus according to claim 13, wherein:

said plurality of segments are substantially flush with the platform.

15. An amusement apparatus according to claim 13, wherein:

each segment has a convex circular leading edge and a concave circular trailing edge.

16. An amusement apparatus, comprising:

a platform defining a slot that follows a continuous course including both clockwise turns and counterclockwise turns;

a plurality of cars each supported by respective wheels that ride on the platform;

an elongate flexible drive member that translates along a path corresponding to said slot;

a plurality of couplers corresponding to said plurality of cars, each respective coupler including a member which couples a corresponding car to said drive member; and a plurality of segments that are coupled to said flexible elongate drive member and move in conjunction with said drive member along said continuous course, wherein at least a portion of said slot is covered by said plurality of segments.

17. An amusement apparatus according to claim 16, wherein:

said plurality of segments is substantially flush with the platform.

18. An amusement apparatus according to claim 16, wherein:

each of said plurality of segments has a convex circular leading edge and a concave circular trailing edge.

19. An amusement apparatus, comprising:

a platform defining a slot that follows a continuous course including both clockwise turns and counterclockwise turns;

a plurality of cars each supported by respective wheels that ride on the platform;

an elongate flexible drive member that translates along a path corresponding to said slot;

a plurality of couplers corresponding to said plurality of cars, each respective coupler including a member which couples a corresponding car to said drive member; and a plurality of segments that are coupled to said flexible elongate drive member and move in conjunction with said drive member along said continuous course, wherein at least a portion of said slot is covered by said plurality of segments, and wherein said wheels of said plurality of cars traverse over said plurality of segments as said car travel over said platform.

* * * * *